US010649383B2

(12) United States Patent
Yamamoto et al.

(10) Patent No.: US 10,649,383 B2
(45) Date of Patent: May 12, 2020

(54) IMAGE FORMING APPARATUS

(71) Applicant: KONICA MINOLTA, INC., Chiyoda-ku, Tokyo (JP)

(72) Inventors: Yusuke Yamamoto, Hachioji (JP); Hiroyuki Arai, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/415,034

(22) Filed: May 17, 2019

(65) Prior Publication Data

US 2019/0354054 A1 Nov. 21, 2019

(30) Foreign Application Priority Data

May 21, 2018 (JP) ..... 2018-097004

(51) Int. Cl.
*G03G 15/00* (2006.01)

(52) U.S. Cl.
CPC ..... *G03G 15/55* (2013.01); *G03G 15/5062* (2013.01)

(58) Field of Classification Search
CPC ..... G03G 15/5065; G03G 15/6517; G03G 15/652; G03G 2215/00455; G03G 2215/00759; G03G 15/5062
See application file for complete search history.

(56) References Cited

FOREIGN PATENT DOCUMENTS

JP 2008074051 A 4/2008
JP 2009078886 A * 4/2009

OTHER PUBLICATIONS

Yamamoto, JP 2009-078886 A, Apr. 2009, JPO Computer Translation (Year: 2009).*

* cited by examiner

*Primary Examiner* — Erika J Villaluna
(74) *Attorney, Agent, or Firm* — Buchanan Ingersoll & Rooney PC

(57) ABSTRACT

An image forming apparatus that forms an image on continuous paper, includes: an image former that forms an image on the continuous paper; a conveyer that conveys the continuous paper in a forward direction that is a conveyance direction at a time of image formation and conveys the continuous paper to the image former; an image diagnosis part that detects abnormality of the image formed by the image former and performs diagnosis of a degree of the detected abnormality; and a hardware processor that switches whether to continue conveyance of the continuous paper in the forward direction according to a result of the diagnosis of the image performed by the image diagnosis part.

15 Claims, 8 Drawing Sheets

IMAGE FORMING APPARATUS

The entire disclosure of Japanese patent Application No. 2018-097004, filed on May 21, 2018, is incorporated herein by reference in its entirety.

BACKGROUND

Technological Field

The present invention relates to an image forming apparatus.

Description of the Related Art

In recent years, in an image forming apparatus, an image is formed, and the formed image is read by a line image sensor to inspect abnormality of the image. In the case of a cut sheet, a paper sheet having abnormality in the image at the time of printing can be excluded as "spoilage" or a "spoilage sheet".

However, there is also an image forming apparatus that continuously performs printing on continuous paper such as roll paper. In the case of continuous paper, even if abnormality is detected during printing, it is not possible to exclude only the portion of spoilage, unlike the cut sheet. Accordingly, there may be a possibility that spoilage is included in the output product. Thus, there has been a problem that man-hours for artificially locate and remove the spoilage portion are required after completion of all the printing on the continuous paper.

In response to such a problem, JP 2008-074051 A discloses a technique of inspecting a printed image on continuous paper using a printing defect detection sensor composed of a line image sensor. When a printing defect is detected, the continuous paper is rewound while maintenance operation of a print head is performed, and a printing defect mark is printed in the printing defect area on the rewound continuous paper. This printing defect mark clarifies the printing defect portion, whereby the printing defect portion can be easily removed.

However, according to the technique of JP 2008-074051 A, the continuous paper is inevitably rewound to perform the maintenance operation of the print head during the rewinding, whereby there may be a problem that an appropriate process corresponding to a cause of occurrence of a printing defect may not be performed so that productivity is lowered.

SUMMARY

The present invention has been conceived in view of the circumstances described above, and an object of the present invention is to provide an image forming apparatus capable of suppressing a decrease in productivity even in the case where a defect occurs in a formed image during image formation on continuous paper.

To achieve the abovementioned object, according to an aspect of the present invention, there is provided an image forming apparatus that forms an image on continuous paper, and the image forming apparatus reflecting one aspect of the present invention comprises: an image former that forms an image on the continuous paper; a conveyer that conveys the continuous paper in a forward direction that is a conveyance direction at a time of image formation and conveys the continuous paper to the image former; an image diagnosis part that detects abnormality of the image formed by the image former and performs diagnosis of a degree of the detected abnormality, and a hardware processor that switches whether to continue conveyance of time continuous paper in time forward direction according to a result of time diagnosis of the image performed by the image diagnosis part.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments. Note that the same elements in the description of the drawings are denoted by the same reference signs, and duplicate description is omitted. In addition, dimensional ratios of the drawings are exaggerated for convenience of explanation, and are different from the actual ratios.

Figure 1:
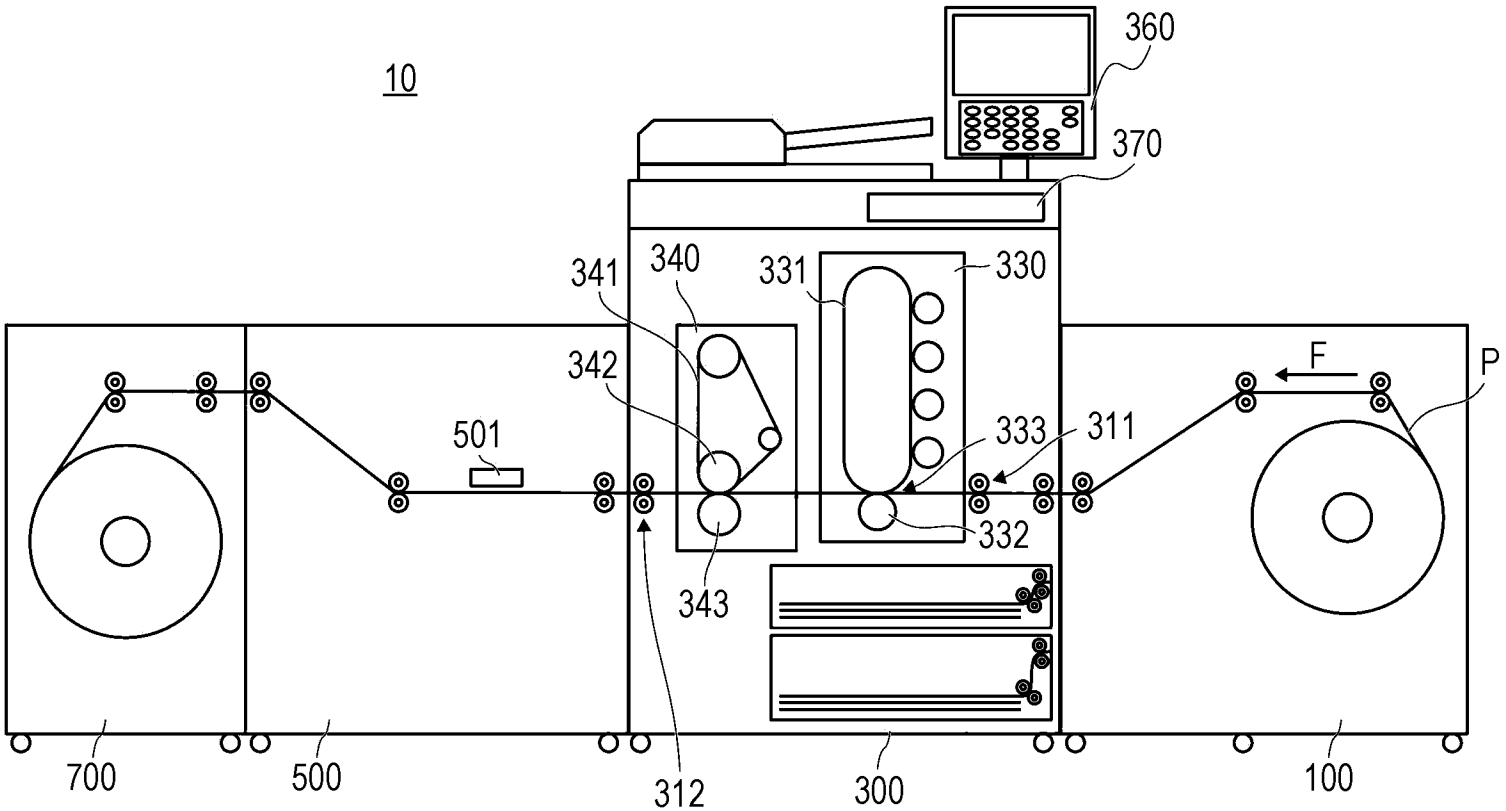
FIG. 1 is a schematic diagram illustrating a configuration of an image forming apparatus according to an embodiment.

FIG. 1 is a schematic diagram illustrating a configuration of an image forming apparatus according to an embodiment.

An image forming apparatus 10 according to the present embodiment uses a paper sheet P as an image recording medium to form an image on the paper sheet P.

From the upstream side with respect to the conveyance direction (arrow F in FIG. 1) of paper sheet P at the time of forming an image (also referred to as print or printing) serving as a forward direction, a paper feeder 100, an image former 300, an image diagnosis part 500, and a paper ejector 700 are connected to the image forming apparatus 10. The paper sheet P used in the image forming apparatus 10 is continuous paper. Here, roll paper is exemplified as the paper sheet P. However, the paper sheet P is not necessarily held in the form of a roll, and may be folded and held. Although only one roll of paper is illustrated in FIG. 1, a plurality of rolls of paper may be held. In the following descriptions, "upstream" and "downstream" refer to the upstream and downstream sides in the forward direction, which is the conveyance direction of the paper sheet P during printing.

The paper feeder 100 is a device for feeding the paper sheet P to the image former 300. In the housing of the paper feeder 100, for example, the paper sheet P is wound around a support shaft and held rotatably. The paper feeder 100 conveys the paper sheet P wound around the support shaft to the outside at a constant speed via a plurality of rollers (e.g., delivering roller and paper feed roller).

Although illustration is omitted, a paper feed adjuster (device) may be disposed between the paper feeder 100 and the image former 300, which is for absorbing the speed difference between the conveyance speed of the paper sheet P in the paper feeder 100 and the conveyance speed of the paper sheet P in the image former 300.

The image former 300 includes a controller 370, a conveyer 310, an image processor 330, a fixing part 340, and an operation panel 360.

The controller 370 controls the conveyer 310 (see FIG. 2), the image processor 330, and the fixing part 340 to form an image on the paper sheet. P. Further, the controller 370 detects abnormality of the image formed on the paper sheet P on the basis of data from the image diagnosis part 500. Furthermore, the controller 370 controls the conveyer 310, the paper feeder 100, and the paper ejector 700 to control the conveyance of the paper sheet P. At the time of forming an image, the controller 370 performs control to feed the paper sheet P from the paper feeder 100 and to wind it up with the paper ejector 700. Meanwhile, at the time of abnormality occurrence, control is performed in such a manner that the paper sheet P is conveyed in the reverse direction and is wound by the paper feeder 100 according to diagnosed content (to be described later in detail). At this time, the paper ejector 700 may be driven as a free rotation, or may perform discharge in the reverse direction. The image processor 330 and the fixing part 340 are also reversed or respective nip pressures are reduced.

The conveyer 310 includes a paper feed conveyance roller 311 (paper feed conveyer), and a paper ejection conveyance roller 312 (paper ejection conveyer). The paper feed conveyance roller 311 is a conveyance mechanism on the paper feed side in the image former 300, which is, for example, a pair of rollers that holds the paper sheet P conveyed from the paper feeder 100 and conveys it to the image processor 330. Meanwhile, the paper ejection conveyance roller 312 is a conveyance mechanism on the paper ejection side in the image former 300, which is, for example, a pair of rollers that holds the paper sheet P having passed through the fixing part 340 and conveys it to the image diagnosis part 500. The paper feed conveyance roller 311 and the paper ejection conveyance roller 312 are driven by a motor (not illustrated).

The image processor 330 forms a toner image through an electrophotographic process, and transfers it onto the paper sheet P. To this end, a plurality of photoconductor drums (e.g., photoconductor drums for Y, M, C, and K) and an intermediate transfer belt 331 are used as image carriers in the image processor 330. The intermediate transfer belt 331 is an endless belt, which is wound by a plurality of rollers and is supported in a travelable manner. The toner images of the respective colors formed on the photoconductor drums of Y, M, C, and K are sequentially transferred onto the intermediate transfer belt 331, and the toner image that is a color image in which layers of the respective colors (yellow (Y), magenta (M), cyan (C), and black (K)) are superimposed is formed on the intermediate transfer belt 331. The intermediate transfer belt 331 and a transfer roller 332 form an image forming nip 333. Then, bias with a polarity opposite to that of the toner is applied to the transfer roller 332, and the image forming nip 333 holds and conveys the paper sheet P, whereby the toner image formed on the intermediate transfer belt 331 is transferred onto the paper sheet P.

The fixing part 340 fixes the toner image on the paper sheet P. The fixing part 340 presses a fixing roller 342 as a Beat source against a pressure roller 343 via a fixing belt 341, thereby forming a nip using the fixing belt 341 and the pressure roller 343. Then, the fixing roller 342 and the pressure roller 343 are rotated to convey the paper sheet P held by the nip. As a result, the fixing part 340 applies heat and pressure to the paper sheet P passing through the fixing part 340 at the nip, whereby the toner image is fused and fixed onto the paper sheet P. The fixing roller 342 and the pressure roller 343 are provided to be capable of being pressed/separated to/from each other via the fixing bell 341.

The operation panel 360 includes a touch panel, a numerical pad, a start button, a stop button, and the like, and is used for display of various kinds of information and input of various instructions.

The image diagnosis part 500 includes a line image sensor 501 provided along the conveyance path. In the line image sensor 501, pixels are aligned in a direction intersecting the paper conveyance direction, and an image is read from the paper sheet being conveyed (moved). The image read by the line image sensor 501 is transmitted to the controller 370. The controller 370 detects abnormality in the image from the received image, and diagnoses a degree of the detected abnormality.

Examples of the abnormal image include inclination of the image, positional deviation of the image, an image flaw (dirt or missing), and a color shift. Those abnormal images are diagnosed in the controller 370 in which the image data obtained by scanning performed by the line image sensor 501 is compared with the image data of the job input to the image forming apparatus 10. Therefore, the controller 370 functions as a part of the image diagnosis part. Alternatively, the image diagnosis part 500 may also include an image diagnosis function (computer) such that the image data of the job is compared with the image read by the line image sensor 501 to make a diagnosis, and a result of the diagnosis may be transmitted to the controller 370. In that case, the controller 370 controls conveyance according to the result of the diagnosis (degree of abnormality).

The paper ejector 700 is a device for ejecting the paper sheet P conveyed from the image former 300 via the image diagnosis part 500. In the housing of the paper ejector 700, for example, the paper sheet P is wound around a support shaft and held in the form of a roll. Accordingly, the paper ejector 700 winds the paper sheet P conveyed from the image diagnosis part 500 around the support shaft at a constant speed via a plurality of rollers (e.g., delivering roller and paper ejection roller). Note that the paper sheet P is not necessarily held in the form of a roll in the paper ejector 700, and may be cut for each page.

Although illustration is omitted, a paper feed adjuster (device) may be installed between the image former 300 and the image diagnosis part 500 or between the image diagnosis part 500 and the paper ejector 700, which holds the paper sheet P in a sagging manner for absorbing the speed difference between the conveyance speed of the paper sheet P in the image former 300 and the conveyance speed of the paper sheet P in the paper ejector 700.

Figure 2:
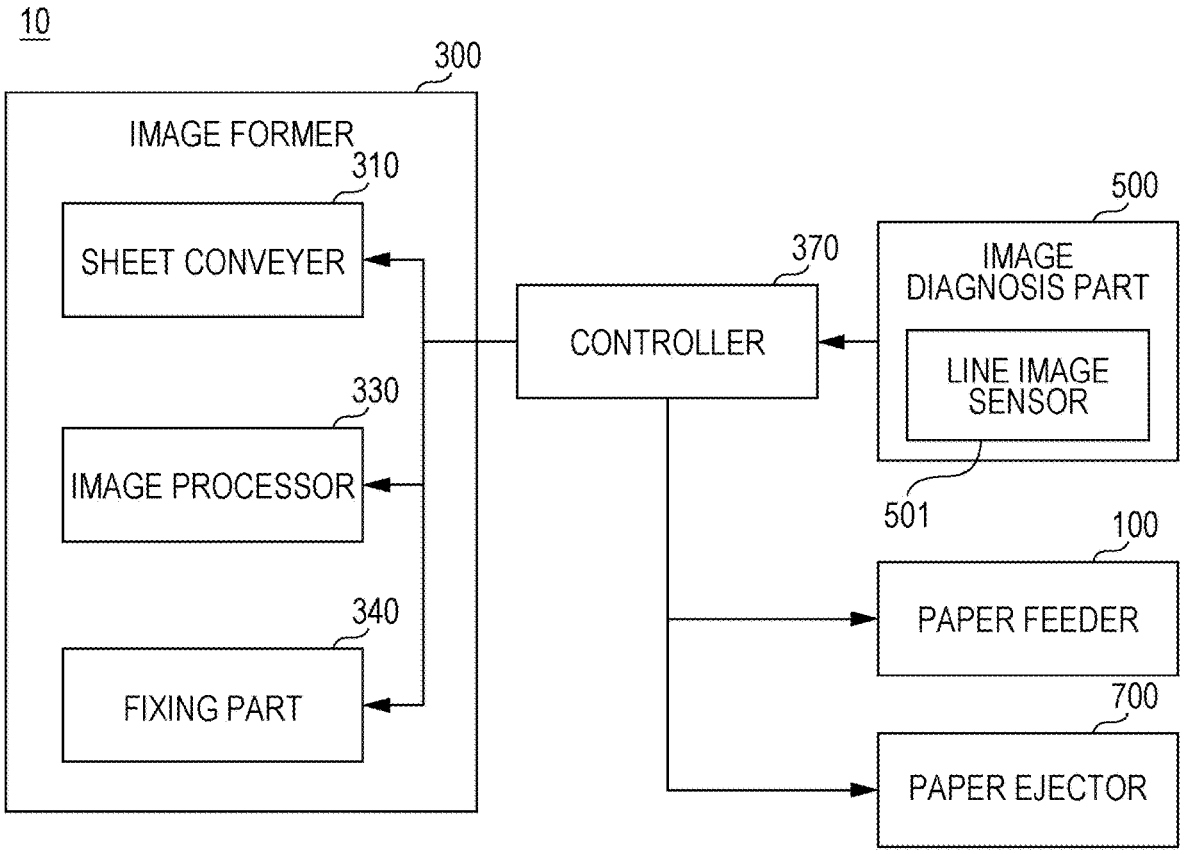
FIG. 2 is a block diagram for illustrating a control system.

FIG. 2 is a block diagram for illustrating a control system.

As illustrated in FIG. 2, the control system is configured such that the controller 370 is connected to the image processor 330, the fixing part 340, and the conveyer 310 in the image former 300 via signal lines to control those parts. Further, the controller 370 receives data of the image read by the line image sensor 501 from the image diagnosis part 500.

The controller 370 is similar to a general computer, and includes a central processing unit (CPU), a memory, a network interface, and the like. The CPU executes control of the entire image forming apparatus 10 in accordance with a program.

The memory includes a read-only memory (ROM) that stores an activation program, and a random access memory (KAM) that is a high-speed accessible main memory for temporarily staring a program and data as a work area of the CPU. It also includes a storage as a memory. The storage is an auxiliary storage device having sufficient capacity to store various programs including an operating system and various kinds of data, for example. The storage is composed of a hard disk, or a flash memory. The network interface is an interface for communicating with another external device (e.g., client computer incorporating a printer driver) via a computer network, for example. Standards such as Ethernet (registered trademark), Wi-Fi, a fiber-distributed data interface (FDDI), and Token Ring are used for communication. The configuration of such a computer is well known, and a detailed description thereof will be omitted.

Next, an abnormal image and a degree of abnormality, an estimated cause of abnormality occurrence, and operation to be made to correspond to each of the degree of abnormality and the cause will be described.

In the present embodiment, various abnormalities that occur in the image are detected, and the cause is estimated from the degree of the abnormality, thereby switching actions of whether the conveyance of the paper sheet P is to be continued, to be stopped, or to be performed in the reverse direction according to the degree of abnormality. Hereinafter, those switching operations will be described together with examples of the image abnormality.

Figure 3:
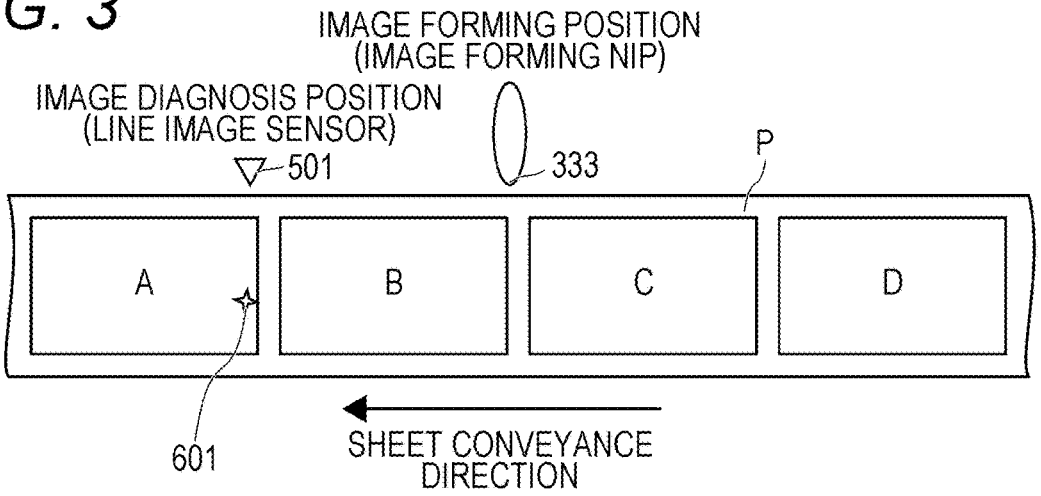
FIG. 3 is an explanatory diagram for illustrating an exemplary abnormal image.

FIG. 3 is an explanatory diagram for illustrating an exemplary abnormal image.

First, an image forming position and an image diagnosis position with respect to the paper sheet P will be described, with reference to FIG. 3. In the drawing, the image forming position is specifically the position of the image forming nip 333, and the image diagnosis position is specifically the position of the line image sensor 501. The paper sheet P is conveyed, in the direction of the arrow, and the distance between the image forming nip 333 and the line image sensor 501 is separated by one image and one margin. Images to be formed are referred to as images A, B, and so on. In the drawing, image formation of the images A and B has already been complete. On the other hand, images C and D indicate portions (positions) where images are to be formed. The same applies to each drawing in the following descriptions.

The exemplary abnormal image illustrated in FIG. 3 is a point flaw 601 that occurs only in a limited portion in the image. An estimated cause of occurrence of such a point flaw 601 is, for example, dirt that has mixed in during image formation (including during fixing; the same applies hereafter), a partial color shift in the image, image misalignment, and the like. Such a point flaw 601 is relatively likely to occur only in one abnormal image due to its cause of occurrence. Accordingly, it is estimated that the frequency of continuous occurrence of the abnormality caused by the same cause is low, and an abnormality diagnosis level is determined to be "low". When an abnormal image is generated, the image that has become an abnormal image will be formed again on the paper sheet P as a recovery image later (e.g., after correction processing (to be described later) for removing the cause of the abnormality).

When such an abnormal image having the abnormality diagnosis level "low" occurs in the image A, the subsequent image B is continuously conveyed to the image diagnosis part 500. The process flow will be described later. Note that, in the present embodiment, the image of the image B has already been formed when the back end of the image A in the conveyance direction reaches the image diagnosis position, as described above.

Figure 4:
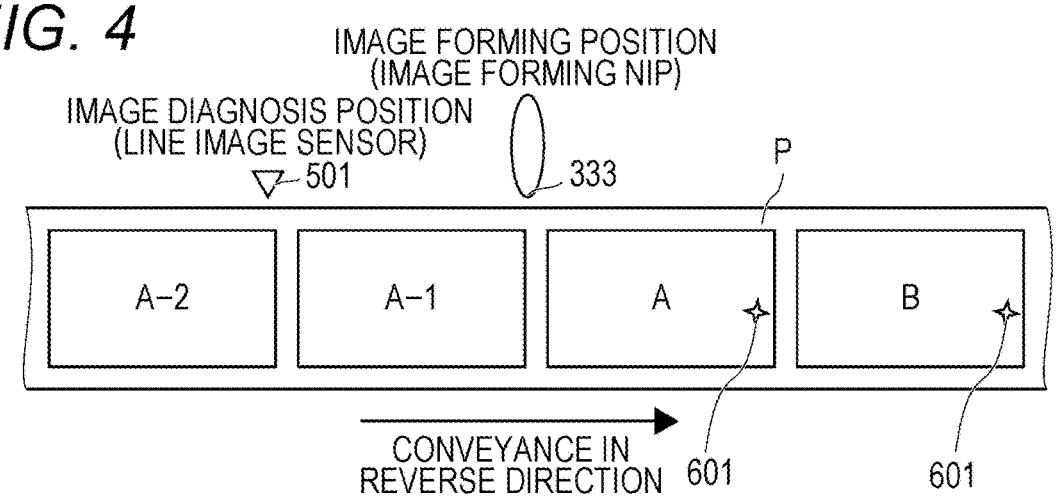
FIG. 4 is an explanatory diagram for illustrating operation of conveying a paper sheet in a reverse direction.

When there is an abnormal image having the abnormality diagnosis level "low" also in the image B, the paper sheet P is conveyed in the reverse direction. FIG. 4 is an explanatory diagram for illustrating operation of conveying the paper sheet P in the reverse direction. As illustrated in FIG. 4, when both of the images A and B are diagnosed as abnormal images, they are returned until the front end of the image A comes before the image forming position. Note that images A-1 and A-2 formed before the image A are illustrated before the image A in FIG. 4.

Thereafter, it is conveyed in the normal image forming direction, and an abnormality mark indicating that the image is an abnormal image is printed (image formation).

Figure 5:
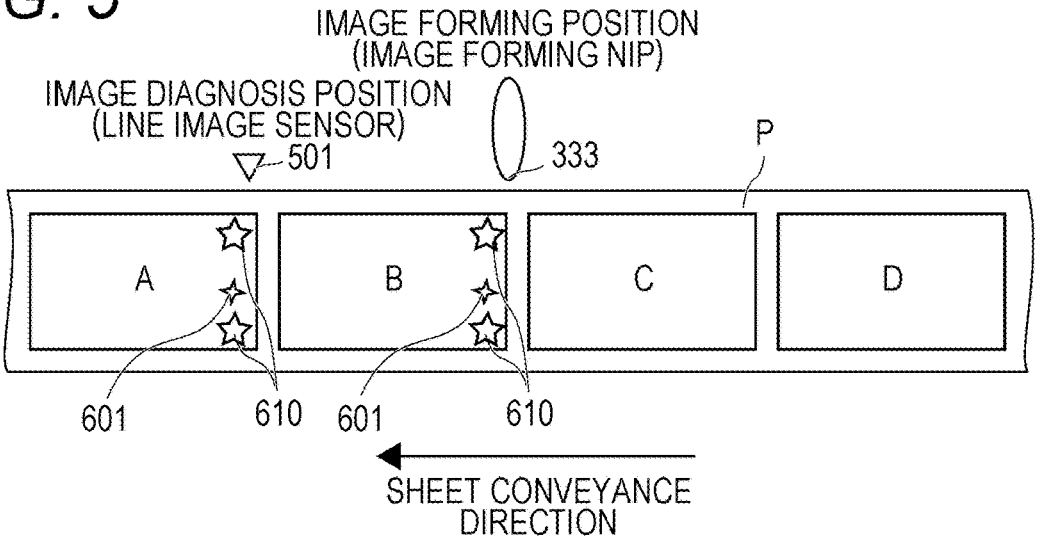
FIG. 5 is an explanatory diagram for illustrating exemplary printing of an abnormality mark.

FIG. 5 is an explanatory diagram for illustrating exemplary printing of the abnormality mark. The exemplary printing of the abnormality mark in FIG. 5 illustrates a case where two abnormal images having the abnormality diagnosis level "low" consecutively occur. When two abnormal images having the abnormality diagnosis level "low" consecutively occur (images A and B illustrated in FIG. 4 in this case), a predetermined abnormality mark 610 is formed in each image Although the abnormality mark 610 is set to be a large star in this case, the abnormality mark 610 may be anything as long as it is a dedicated mark to make it possible to distinguish that the image includes abnormality at a later stage. For example, it is not limited to a predetermined shape, and may be characters such as "abnormality" and "spoilage". A printing position of the abnormality mark is preferably specified in advance, such as the center of the image, the portion at which abnormality has occurred, and a margin of the image in which abnormality has occurred (as long as a position where an image can be formed). In addition, when the image forming portion which is "A", "B", and the like illustrated in the drawing, is an image, the printing position of the abnormality mark is preferably printed at a position not overlapping therewith. This makes it easy to see the abnormality mark.

Furthermore, the abnormality mark may vary depending on the abnormality diagnosis level. For example, in the case of two stages of abnormality diagnosis levels "low" and "high", the magnitude of the abnormality mark (star in the drawing) may be changed in two stages.

Figure 6:
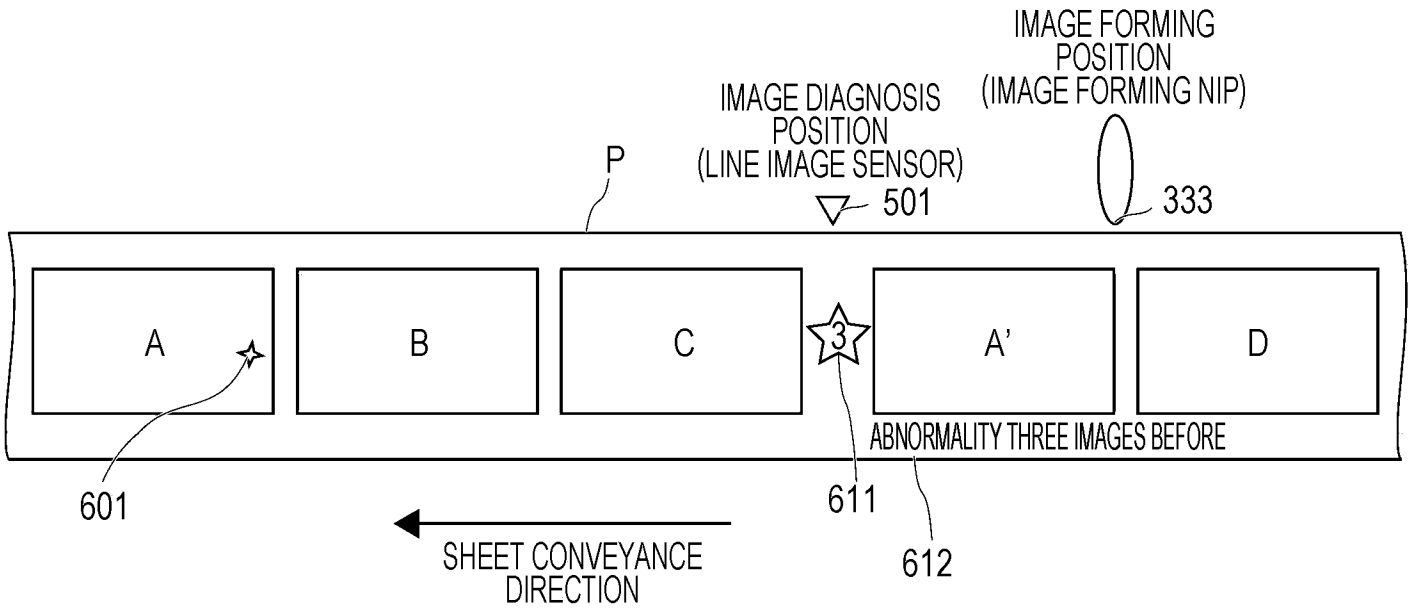
FIG. 6 is an explanatory diagram for illustrating another exemplary printing of the abnormality mark.

FIG. 6 is an explanatory diagram for illustrating another exemplary printing of the abnormality mark. The other exemplary printing of the abnormality mark illustrated in FIG. 6 is an example of printing in the case where abnormality has occurred in only one image at the abnormality diagnosis level "low". When abnormality has occurred in only one image at the abnormality diagnosis level "low", in the present embodiment, the paper sheet P is conveyed in the forward direction without being conveyed in the reverse direction, and an abnormality mark 611 is printed. The abnormality mark 611 in this case indicates in what number of images before the position at which the abnormality mark 611 is printed (in the direction in which images have already been formed) an abnormal image exists. In FIG. 6, since the image A is an abnormal image, the printing of the abnormality mark indicates the number "3" together with the star that is the abnormality mark 611. That is, it is indicated that abnormality exists in the image three images before the abnormality mark 611.

In this example, the abnormality mark 611 is printed after the image C. The image formation of the image C has already been complete at the time when the image B passes the image diagnosis position. Therefore, when the image A is an abnormal image in this example, the position of printing of the abnormality mark is after the image C at the fastest. However, the abnormality mark is not necessarily printed at the fastest (closest position) from the detection of the abnormal image, and may be printed after the job is complete. The completion of the job is processing in the case where no subsequent image exists, which is to be described later. Further, the abnormality mark 611 may be formed not only between the images (between the image C and a recovery image A' to be described later in FIG. 6), but also in a margin (outside the image). For example, an abnormality mark 612 is formed outside the recovery image A' illustrated in FIG. 6. In that case, the abnormality mark 611 is unnecessary obviously, and the image interval can be narrowed accordingly (paper sheet can be effectively used).

The recovery image A' may be formed continuously after the abnormality mark is printed. In the case of the abnormality diagnosis level "low", since possibility of occurrence of abnormality is low except for the abnormal image, a normal image may be obtained if the same image is directly recovered to form an image. It is obviously possible to form an image after correction processing (to be described later) for removing the cause of the abnormality (detailed processing procedure will be described later; the same applies hereafter).

Figure 7:
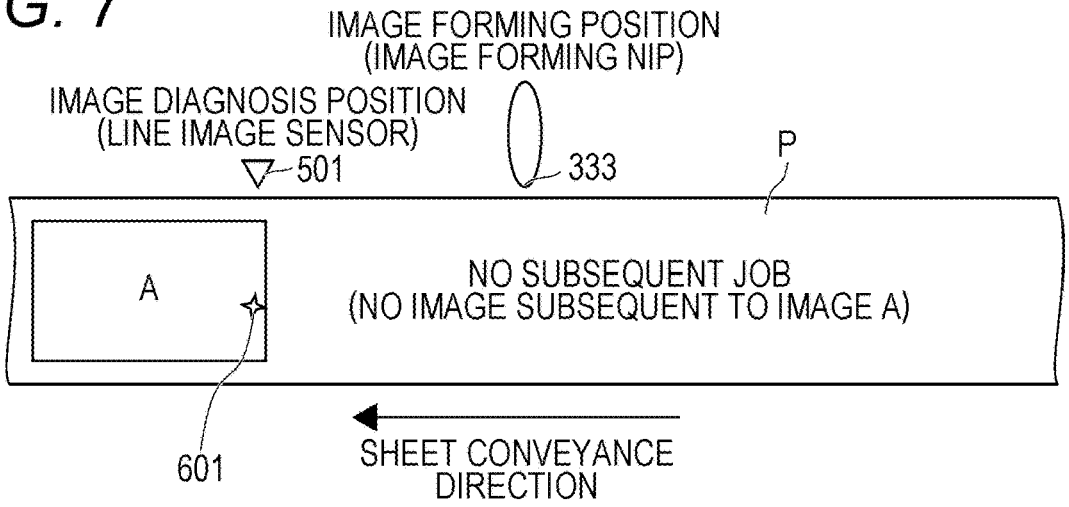
FIG. 7 is an explanatory diagram for illustrating a case where no subsequent image exists after detection of an abnormal image.

Next, a case where no subsequent image exists after detection of an abnormal image will be described. FIG. 7 is an explanatory diagram for illustrating the case where no subsequent image exists after detection of an abnormal image. As illustrated in FIG. 7, when no subsequent image exists at the time when the image A is diagnosed as an abnormal image, that is, the image A diagnosed as the abnormal image is the final image, the conveyance of the paper sheet P stops at that time. Thereafter, the abnormality mark is printed, the correction processing for correcting the abnormality is performed, and then a recovery image is formed.

Figure 8:
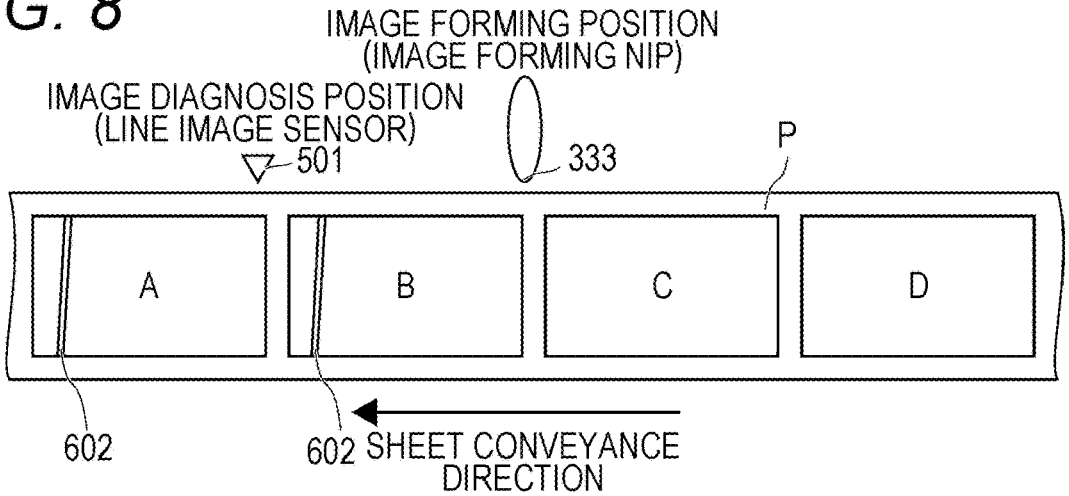
FIG. 8 is an explanatory diagram for illustrating an example of skew misalignment as image abnormality.

Another abnormal image will be further described. FIG. 8 is an explanatory diagram for illustrating an example of skew misalignment as image abnormality. As illustrated in FIG. 8, an oblique line runs in the image A in the main scanning direction (direction intersecting the conveyance direction). When such an oblique line does not exist in the original image, it is diagnosed as skew misalignment. In the case of the skew misalignment, there may be a case where the skew misalignment occurs in a part of the image, or may be a case where the skew misalignment occurs in the entire image. There may be also a difference in angle of the skew misalignment. Accordingly, an abnormality diagnosis level of the skew misalignment is set such that the skew misalignment that occurs in a part of colors in the image is in the abnormality diagnosis level "low" while a case where the skew misalignment occurs in the entire image so that the entire image is oblique is in the abnormality diagnosis level "high". In addition, a case where the angle of the oblique line is large is set to be the abnormality diagnosis level "high". For the angle of the oblique line when the abnormality diagnosis level is set to "high", an angle within a range considered to be allowable even if the entire image is slightly oblique is determined in advance.

When the skew misalignment occurs, it is highly likely that the subsequent image (image B) will be an abnormal image in a similar manner. In such a case, the conveyance of the subsequent paper sheet P stops. In that case, the conveyance may be stopped at that point without carrying out the conveyance in the reverse direction to allow a user to confirm the abnormal image. As a cause of occurrence of large skew misalignment, some kind of abnormality (failure or adjustment failure) may have occurred in the image processor 330 or the fixing part 340 on the original paper sheet, whereby it is set to notify the user to prompt him/her to perform maintenance or the like.

Meanwhile, when the skew misalignment is small and the abnormality diagnosis level is "low", the skew misalignment may be temporal. In that case, the conveyance is continued and the next image is diagnosed. For example, when the skew misalignment is detected in the image A and the abnormality diagnosis level is "low", the conveyance is continued, and a recovery image formation of the image A is performed when the skew misalignment does not occur in the image B. In this recovery image formation, when the same skew misalignment is detected again, it can be determined that the skew misalignment occurs in a part of colors or the like. That is, it is presumed that the skew misalignment occurs in a color that appears in the image A and does not appear in the image B. Such a color shift is highly likely based on a failure or an adjustment failure of the device, whereby the conveyance of the paper sheet P stops so that no further waste is caused.

Figure 9:
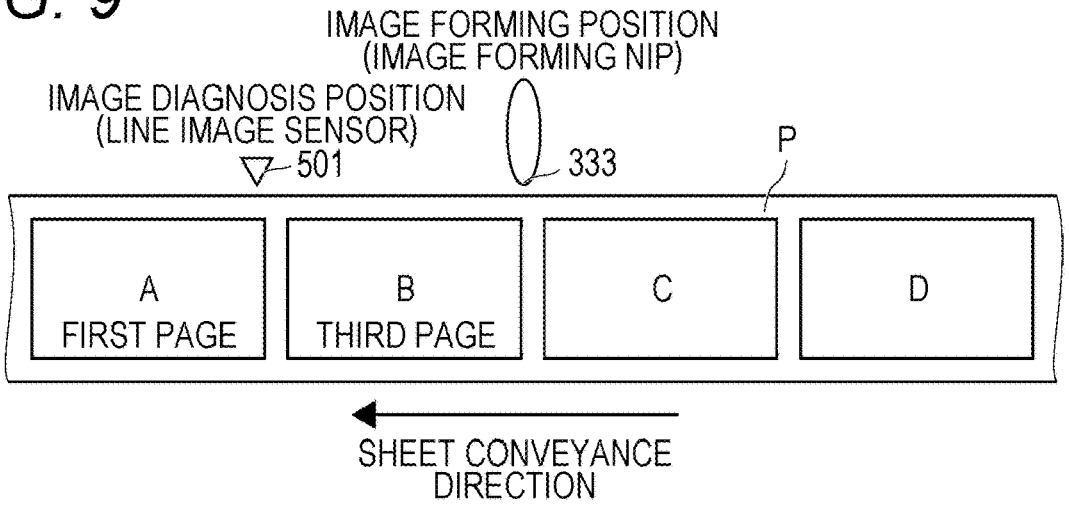
FIG. 9 is an explanatory diagram for illustrating an example of a page error as image abnormality.

FIG. 9 is an explanatory diagram for illustrating an example of a page error as image abnormality. As illustrated in FIG. 9, after the image of the first page is formed on the image A, the image of the third page is formed as the image B. At this time, when the second page comes after the first page in the job data, the state illustrated in FIG. 9 is considered to be a state with a page error. Such a page error is the abnormality diagnosis level "low". Accordingly, the conveyance of the paper sheet is continued, and the subsequent image C is diagnosed. In the diagnosis of the image C, when the image of the fourth page is formed or an image without a page number is formed, the image formation is continued thereafter. In that case, an abnormality mark indicating existence of the page error may be printed. When such page error occurs, the image itself is not an abnormal image that cannot be used. Therefore, it is highly likely that the same abnormality detection result will not be obtained even if the subsequent image is conveyed to the image diagnosis part 500, whereby it is worth continuing image diagnosis with the abnormality diagnosis level "low".

When no abnormality exists in the subsequent image C, the subsequent image (image D) is further conveyed. In this manner, after the image in which abnormality is detected, abnormality diagnosis of a plurality of images can be performed.

Figure 10:
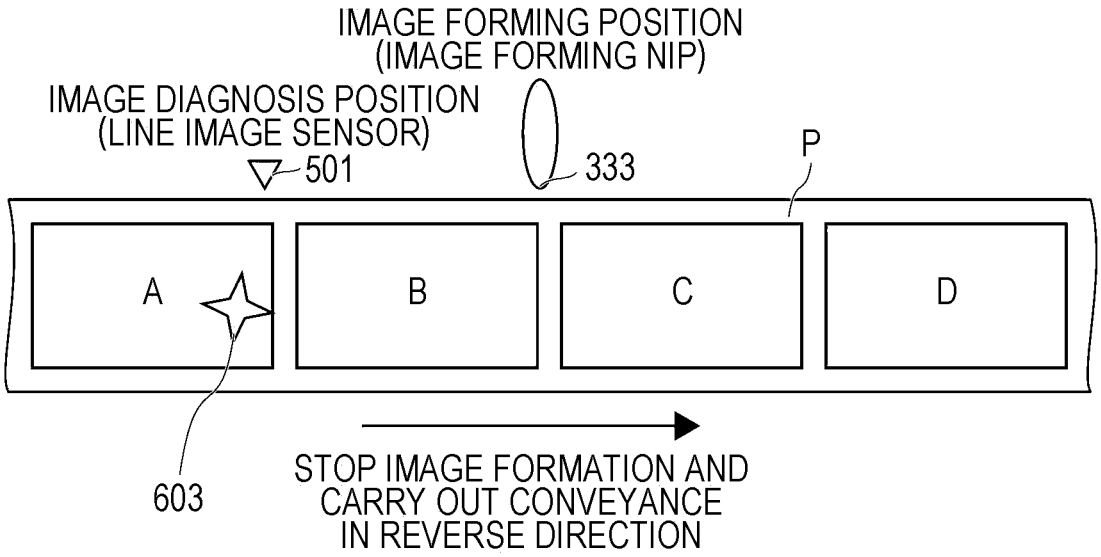
FIG. 10 is an explanatory diagram for illustrating an example of a large image flaw as image abnormality.

FIG. 10 is an explanatory diagram for illustrating an example of a large image flaw as image abnormality. As illustrated in FIG. 10, when there is a large image flaw 603 in the image A, the abnormality diagnosis level is set to be "high". For example, as a portion of pixels different from the job data is detected as an abnormality area, the size of the image flaw 603 (e.g., discrimination between the point flaw 601 and the image flaw 603 illustrated in FIG. 3) is determined to be the point flaw 601 when the number of pixels is less than the predetermined number of pixels for discrimination and to be the image flaw 603 when the number of pixels is equal to or more than the predetermined number of pixels. The number of pixels for discrimination may be optionally set. For example, since the point flaw 601 is caused by missing pixels or dirt as described above, it is highly likely that the point flaw 601 is less than 10 pixels. On the other hand, since the image flaw 603 is caused by failure or adjustment failure of a layer former and the fixing part 340, it is highly likely that the image flaw 603 becomes a large image defect of 10 pixels or more. Since it differs depending on the configuration (especially maximum resolution) of the image former 300 or the like, the number of pixels for discrimination is obviously not limited to 10 pixels.

In the case of the image flaw 603, although the abnormality diagnosis level is "high", abnormality based on the same cause does not necessarily occur in the subsequent image. Therefore, it is preferable to continue the conveyance in the forward direction to diagnose the next image B. When the image B is a normal image, the conveyance is carried out in the reverse direction thereafter, and an abnormality mark is printed in the image forming area of the image A. In this manner, the occurrence of abnormality having a high abnormality diagnosis level can be explicitly indicated. Thereafter, the conveyance in the forward direction is restarted, and image formation is continued.

Figure 11:
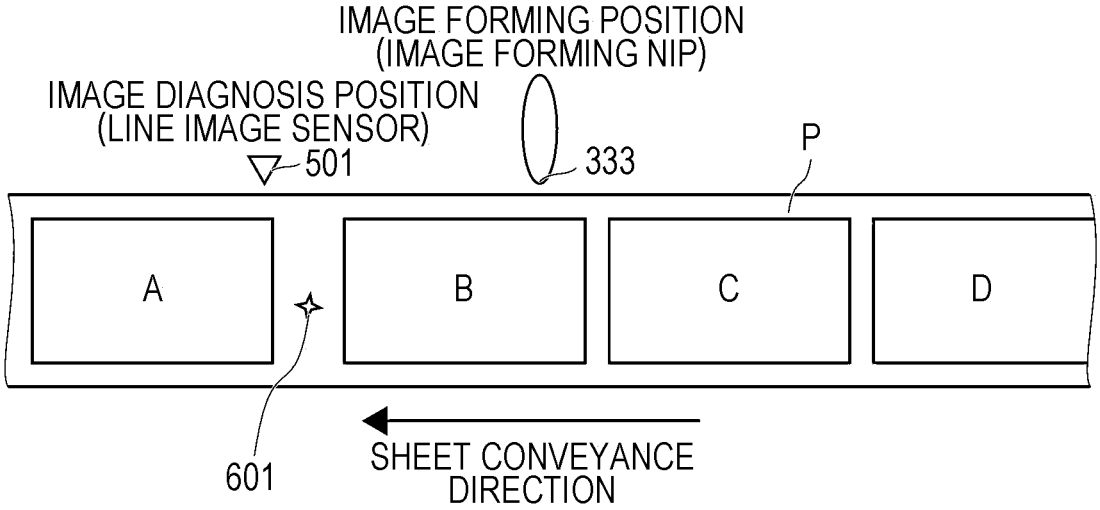
FIG. 11 is an explanatory diagram for illustrating an exemplary case where linage abnormality occurs in a margin.

FIG. 11 is an explanatory diagram for illustrating an exemplary case where image abnormality occurs in a margin. As illustrated in FIG. 11, when there is the point flaw 601 between the image A and the image B, the abnormality diagnosis level is set to be "low". Moreover, this point flaw 601 exists at a position not overlapping the image. Accordingly, it does not affect the created printed matter. Therefore, in such a case, the conveyance of the paper sheet P is continued, and the image formation is also continued.

Figure 12:
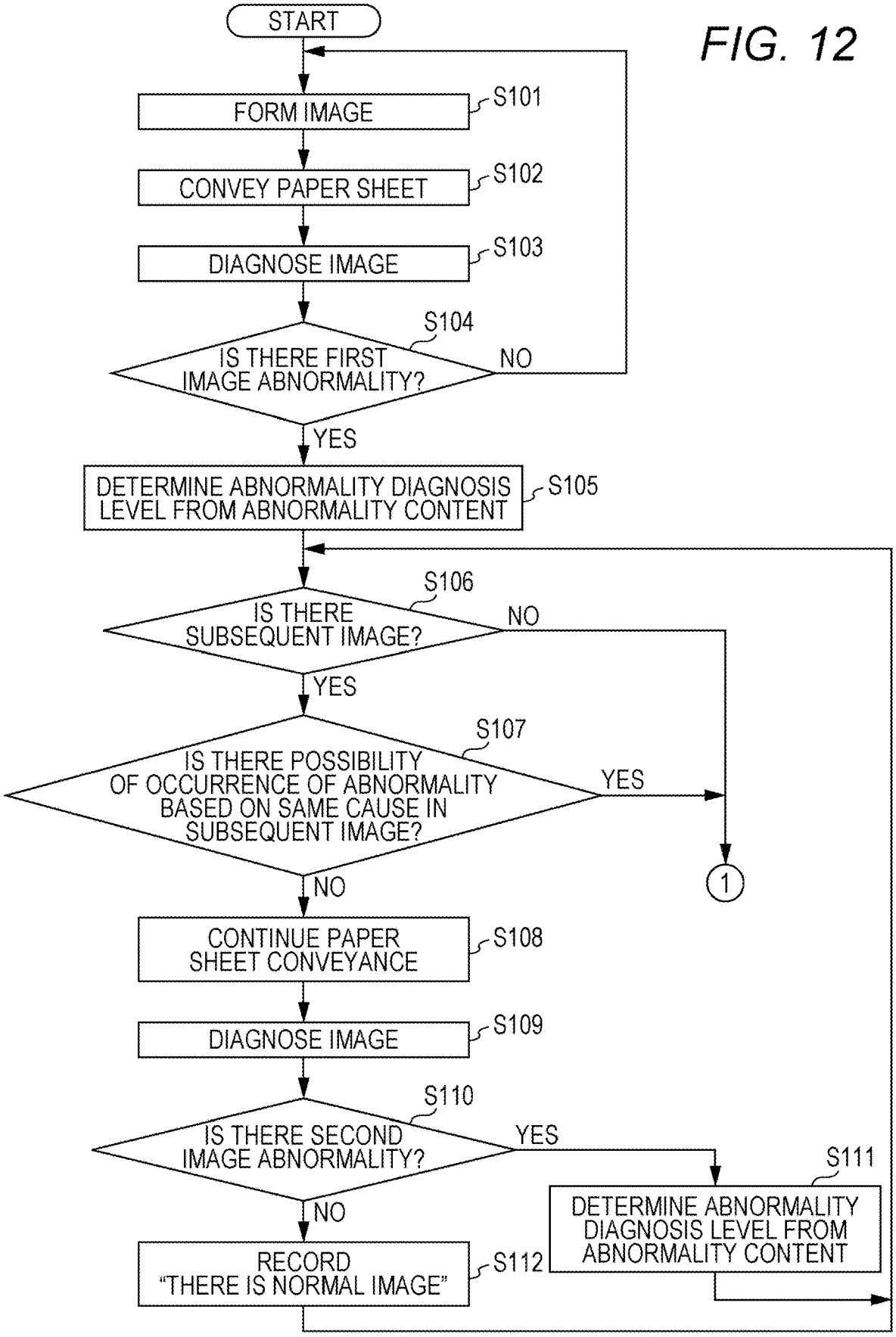
FIG. 12 is a flowchart illustrating a processing procedure of an image diagnosis and a method of forming an image according to a result of the diagnosis.
Figure 13:
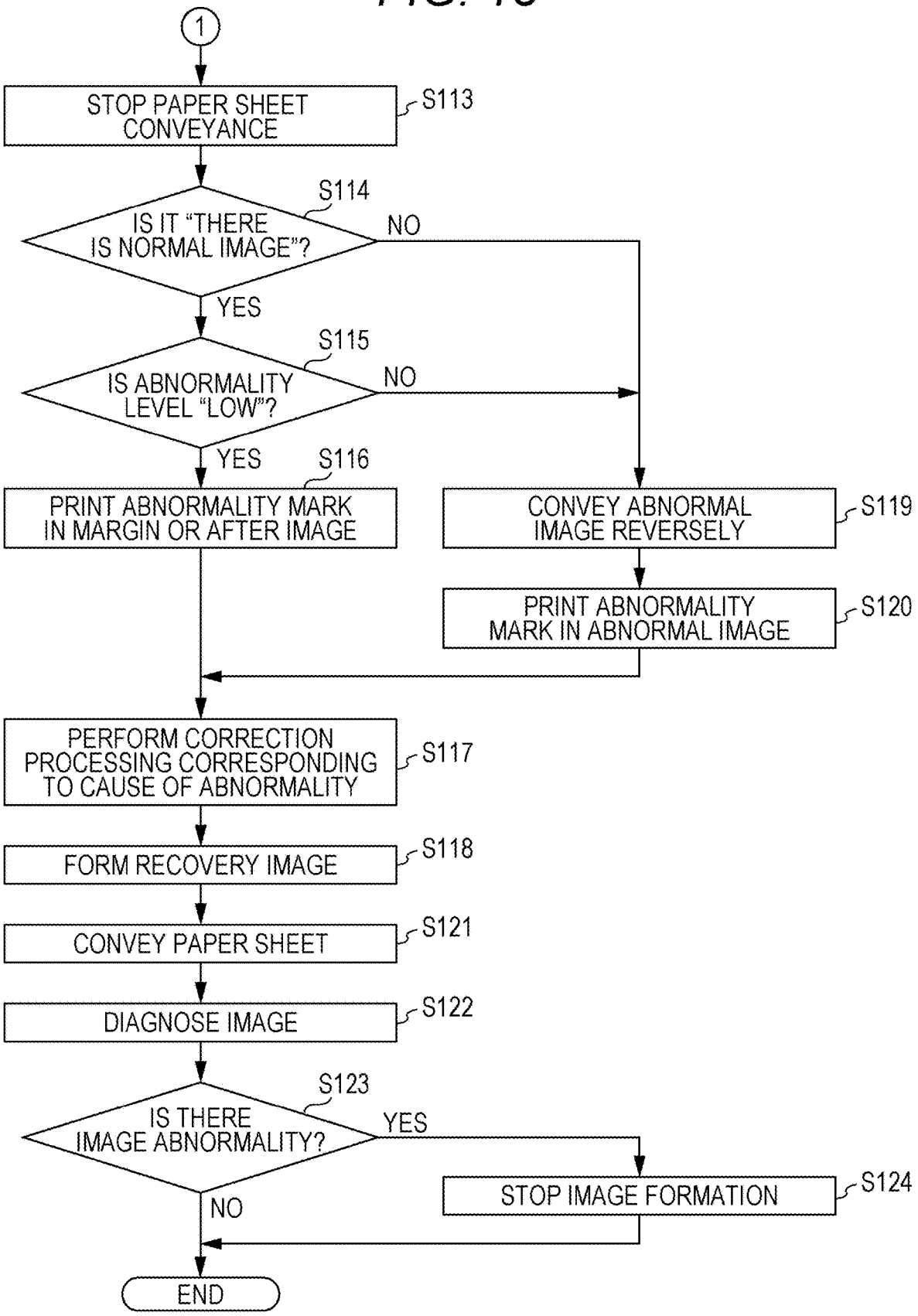
FIG. 13 is a flowchart illustrating a processing procedure of the method of forming an image continuing from FIG. 12.

Next, a method of forming an image will be described. FIGS. 12 and 13 are flowcharts illustrating processing procedures of the image diagnosis and the method of forming an image according to a result of the diagnosis.

The processing procedure is performed by the controller 370 executing a program for implementing the processing procedure.

First, the controller 370 forms an image according to a job input from a client computer or the like (S101), and conveys the paper sheet (S102).

Subsequently, the controller 370 performs image diagnosis using image data from the image diagnosis part 500 (S103). Here, when no abnormal image is detected (NO in S104), the process returns to S101, and the next image is formed (image formation is continued; conveyance is continued).

On the other hand, when an abnormal image is detected (YES in S104), it is determined that a first abnormal image is detected, and an abnormality diagnosis level corresponding to content of abnormality of the first abnormal image is determined (S105). The determined abnormality diagnosis level is temporarily stored in the RAM. The abnormality diagnosis level may be stored in a hard disk drive (HDD) or the like so that it can be checked later as a history.

Subsequently, the controller 370 determines whether there is a subsequent image, and when there is no subsequent image (NO in S106), the process proceeds to S113. On the other hand, when there is a subsequent image (YES in S106), the controller 370 then determines whether there is a possibility of occurrence of abnormality based on the same cause in the subsequent image (S107). Examples of the abnormality to be determined that there is a possibility of occurrence of abnormality based on the same cause in the subsequent image include large skew misalignment and a color shift. Those abnormalities are stored in advance, and when those abnormalities occur, it is determined that there is a possibility of occurrence of abnormality based on the same cause in the subsequent image.

When it is determined, that there is a possibility of occurrence of abnormality based on the same cause in the subsequent image (YES in S107), the process proceeds to S113.

On the other hand, when there is no possibility of occurrence of abnormality based on the same cause in the subsequent image (NO in S107), the controller 370 continues to convey the paper sheet (S108), and performs image diagnosis (S109). When an abnormal image is detected at this stage, it is determined to be a second abnormal image (YES in S109), and an abnormality diagnosis level of the second abnormal image is determined from content of the abnormality (S111). Thereafter, the process returns to S106 to continue the process.

On the other hand, when there is no second abnormal image as a result of the image diagnosis (NO in S109), the fact that there is a normal image is recorded (stored in the RAM) (S112). Thereafter, the process returns to S106 to continue the process. When there is no second abnormal image, the controller 370 thereafter advances the process to S113 at the time when no subsequent image exists in S106 due to completion of the job.

The processing of S113 and subsequent steps will be described. When the process comes to S113, the controller 370 stops the conveyance of the paper sheet P (S113). It is then determined whether there is a normal image (S114). The determination is made with reference to the record in S112. When there is no abnormal image here (NO in S114), the abnormal image is reversely conveyed (S119), and an abnormality mark is printed in the abnormal image (S120). Thereafter, the controller 370 advances the process to S117.

On the other hand, when there is a normal image (YES in S114), the controller 370 then determines whether the abnormality diagnosis level of the detected abnormal image is "low" (S115). Here, when the abnormality diagnosis level is not "low" (NO in S115), the process proceeds to S119. On the other hand, when the abnormality diagnosis level is "low" (YES in S115), an abnormality mark is printed in a margin or after the image (S116).

Thereafter, the controller 370 performs the correction processing corresponding to the cause of the abnormality (S117). Note that the processing here includes failure repair of the device and the like, and it waits for correction processing thereof. Examples of the correction processing, which is correction corresponding to each cause of abnormality that has occurred, include image density correction, image density curve correction, image color shift correction, toner density recovery correction, fixing temperature correction, operation of preventing toner spill, operation of cleaning a band electrode, drum refreshing operation, fixing belt refreshing operation, recovery operation of a cleaning blade, developer refreshing operation, image magnification/position correction, sheet deviation correction, and fixing conveyance speed correction.

After the correction processing, the controller 370 forms a recovery image (S118). Thereafter, the controller 370 conveys the paper sheet (S121), and performs image diagnosis (S122). When an abnormal image is detected at this stage (YES in S123), it is considered that the cause of occurrence of the abnormality cannot have been removed by the correction processing, and the image formation stops (S124). At this time, it is preferable to notify the user of the occurrence of abnormality (including the fact that the correction processing cannot recover the abnormality) without carrying out the conveyance in the reverse direction. After the image formation stops, the process is terminated. Particularly, detection of the abnormal image at this stage indicates that a normal image cannot be obtained even if the correction processing is performed, whereby the entire device is preferably stopped. As a result, no signal indicating that the image forming apparatus 10 is in operation is issued so that a job cannot be input to a computer or the like to which a job is input, whereby unnecessary operation can be suppressed.

On the other hand, when there is no abnormality in the recovery image, the process is terminated as it is after the final image formation in this processing procedure, and preparation for the next image formation (job input) is made.

According to the present embodiment described above, an abnormal image is detected, and actions are switched between continued conveyance of the paper sheet, a stop (interruption), and conveyance in the reverse direction according to the degree of abnormality, whereby a decrease in productivity of image formation on continuous paper can be minimized and occurrence of spoilage can also be minimized. Further, a recovery image is formed after correction processing is performed corresponding to the abnormal image, whereby the possibility that the formed recovery image becomes a normal image can be increased.

Furthermore, the abnormal image is classified into image diagnosis levels, and when the image diagnosis level is "low", an abnormality mark is printed while conveyance in the forward direction is continued without carrying out the conveyance in the reverse direction, whereby a decrease in productivity can be suppressed. On the other hand, when the image diagnosis level is "high", conveyance is carried out in the reverse direction and the abnormality mark is printed in the image area, whereby occurrence of large abnormality can be easily recognized.

When it is presumed that, at the time of occurrence of the abnormal image, there is a possibility of occurrence of abnormality based on the same cause in the subsequent image, the conveyance of the paper sheet stops, whereby occurrence of spoilage can be reduced.

The present invention is not limited to the embodiment described above. For example, although the image diagnosis levels have been two levels of "low" and "high", three or more levels may be set.

When the image diagnosis level is "low" (YES in S115), a recovery image of the image with the image diagnosis level "low" may be formed without performing the correction processing (S117). As described above, when the image diagnosis level is "low", abnormality may have sporadically occurred in only one image. Therefore, a normal image may be obtained if a recovery image is formed without performing the correction processing. In that case, instead of determination in S115, printing of the abnormality mark and formation of the recovery image may be performed following the determination that the second abnormal image does not exist in S112 (NO in S112).

In the embodiment described above, when the image diagnosis level is "high", the paper sheet P is conveyed in the reverse direction, and then the abnormality mark is printed on the image with the image diagnosis level "high". However, it is not limited thereto, and even in the case of the image diagnosis level "high", conveyance may be carried out in the forward direction without conveying the image in the reverse direction, and the abnormality mark may be printed. In that case, it is highly likely that abnormality occurs even after the abnormality mark is printed, whereby the subsequent conveyance of the paper sheet stops. When the conveyance in the reverse direction is not carried out in this manner, the conveyer 310 may not have a function of conveyance in the reverse direction.

Moreover, although it is determined whether abnormality based on the same cause occurs in the subsequent image in the processing procedure of S107, instead of such a procedure, when the abnormality diagnosis level of the first abnormal image is determined to be "high", the process may proceed to S113 on the assumption that the abnormality based on the same cause may occur in the subsequent image as well.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus that forms an image on continuous paper, comprising:

an image former that forms an image on the continuous paper;

a conveyer that conveys the continuous paper in a forward direction that is a conveyance direction at a time of image formation and conveys the continuous paper to the image former;

an image diagnosis part that detects abnormality of the image formed by the image former and performs diagnosis of a degree of the detected abnormality; and a hardware processor that switches whether to continue conveyance of the continuous paper in the forward direction according to a result of the diagnosis of the image performed by the image diagnosis part, wherein the conveyer is capable of performing conveyance in a direction reverse of the forward direction, and the hardware processor switches the conveyance of the continuous paper to either the conveyance in the forward direction or the conveyance in the reverse direction according to the result of the diagnosis of the image performed by the image diagnosis part.

2. The image forming apparatus according to claim 1, wherein when the image diagnosed as abnormal by the image diagnosis part is a final image, the hardware processor stops the conveyance in the forward direction.

3. The image forming apparatus according to claim 1, wherein when the image is diagnosed as abnormal by the image diagnosis part and a subsequent image is presumed to be subject to occurrence of the abnormality based on the same cause, the hardware processor stops the conveyance of the continuous paper in the forward direction.

4. The image forming apparatus according to claim 1, wherein when the image is diagnosed as abnormal by the image diagnosis part and a subsequent image is not presumed to be subject to occurrence of the abnormality based on the same cause, the hardware processor continues the conveyance of the continuous paper in the forward direction.

5. The image forming apparatus according to claim 1, wherein the hardware processor:

sets the image diagnosed as abnormal by the image diagnosis part as a first abnormal image;

classifies the first abnormal image into levels according to a predetermined abnormality diagnosis level; and stops the conveyance when an image next to the first abnormal image is diagnosed as not abnormal and the abnormality diagnosis level of the first abnormal image is high.

6. The image forming apparatus according to claim 5, wherein the abnormality diagnosis level is high when an abnormality area in the abnormal image is larger than a predetermined size.

7. The image forming apparatus according to claim 5, wherein when the abnormality diagnosis level of the first abnormal image is low, the hardware processor continues the conveyance of the continuous paper in the forward direction.

8. The image forming apparatus according to claim 7, wherein the abnormality diagnosis level is low when an abnormality area exists outside the abnormal image.

9. The image forming apparatus according to claim 1, wherein the hardware processor:

sets the image diagnosed as abnormal by the image diagnosis part as a first abnormal image;

classifies the first abnormal image into levels according to a predetermined abnormality diagnosis level; and performs the conveyance in the reverse direction when an image next to the first abnormal image is diagnosed as not abnormal and the abnormality diagnosis level of the first abnormal image is high.

10. The image forming apparatus according to claim 1, wherein the hardware processor causes an abnormality mark for indicating existence of abnormality in the image in which the abnormality has been detected to be printed in an image area after the conveyance in the reverse direction.

11. The image forming apparatus according to claim 10, wherein the hardware processor causes the abnormality mark to be printed at a position not overlapping an image in the image area.

12. The image forming apparatus according to claim 1, wherein when the conveyance of the continuous paper in the forward direction is continued, the hardware processor prints an abnormality mark for indicating existence of abnormality in the image in which the abnormality has been detected in a margin of an image next to the image in which the abnormality has been detected or between the images.

13. The image forming apparatus according to claim 1, wherein the hardware processor causes correction processing to be performed according to the result of the diagnosis of the image.

14. The image forming apparatus according to claim 13, wherein when abnormality is detected in an image formed after the correction processing, the hardware processor does not perform the conveyance in the reverse direction.

15. The image forming apparatus according to claim 13, wherein when abnormality is detected in an image formed after the correction processing, the hardware processor stops subsequent image formation.

* * * * *